United States Patent [19]

Foster et al.

[11] 4,373,711

[45] Feb. 15, 1983

[54] INSERTER FEEDER ASSEMBLIES

[75] Inventors: Dean H. Foster, Stratford; Harold Silverman, Norwalk, both of Conn.

[73] Assignee: Pitney Bowes Inc., Stamford, Conn.

[21] Appl. No.: 185,857

[22] Filed: Sep. 11, 1980

[51] Int. Cl.[3] ..... B65H 1/00

[52] U.S. Cl. ..... 271/171

[58] Field of Search ..... 271/171, 160, 223, 224, 271/124

[56] References Cited

U.S. PATENT DOCUMENTS 2,785,893 3/1957 Ford ..... 271/171 X

FOREIGN PATENT DOCUMENTS 660708 11/1951 United Kingdom ..... 271/171

2010228 6/1979 United Kingdom ..... 271/171

OTHER PUBLICATIONS

Xerox Disclosure Journal, vol. 4, No. 5, Sep./Oct. 1979, pp. 627, 628, "Paper Tray Side Guides", Bernard J. Riley.

*Primary Examiner*—Richard A. Schacher

*Attorney, Agent, or Firm*—Donald P. Walker; William D. Soltow, Jr.; Albert W. Scribner

[57] ABSTRACT

An inserter is adapted to insert successive enclosures from a stack carried by an enclosure feeder assembly into envelopes carried by an envelope feeder assembly. Each feeder assembly includes a sloped tray and a pair of side guides which engage the ends of the stack of materials being fed. Both side guides are adjusted by releasing a tab adjacent one of the guides and sliding the guide. An endless belt mounted beneath the tray assures symmetrical displacement of both guides relative to the center of the tray. A feed wheel is carried along a drive shaft which extends transversely above the tray. The hub of the feed wheel includes a one way clutch which permits adjustment of the feed wheel position. A separator stone projecting from beneath the tray in staggered registration with the feed wheel includes a stone shield. Both the stone and the stone shield are adjustable through control knobs accessible at the front of the inserter. One of the enclosure inserters includes an adjustable mount for spring biased skis which depend from the underside of its tray and engage enclosures which are being transported from a further feeder assembly.

6 Claims, 14 Drawing Figures

FIG. 6
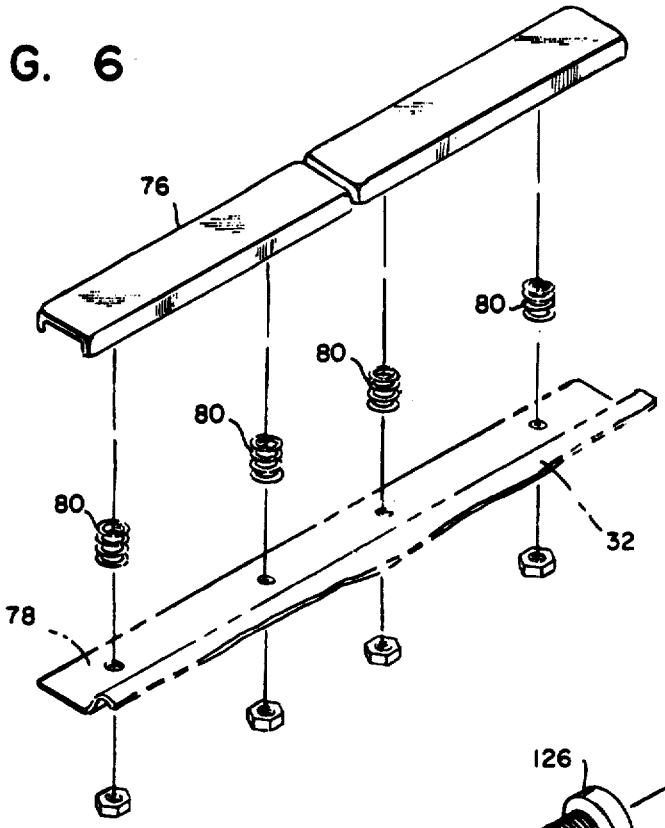
FIG. 7
| | |
|---|---|
| | FIG. 3 |
| | FIG. 6 |
| FIG. 4 | FIG. 5 |
FIG. 8
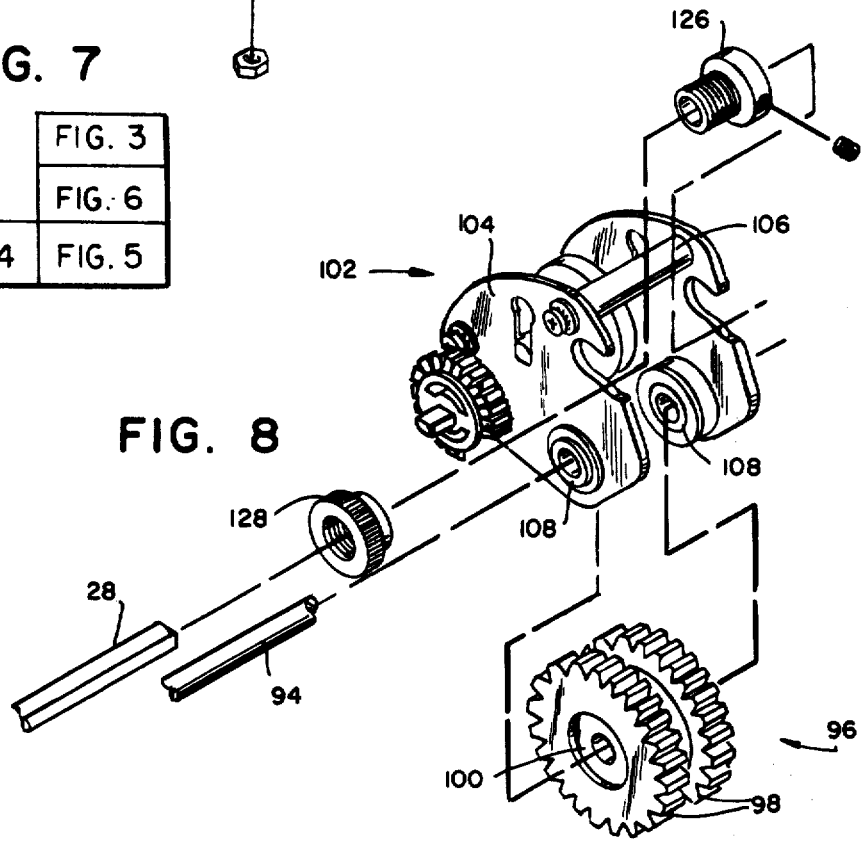

INSERTER FEEDER ASSEMBLIES

BACKGROUND OF THE INVENTION

1. Field of the invention

This invention relates generally to inserters and more particularly to inserter feeder assemblies.

2. Brief Description of the Prior Art

Inserters have played a significant role among the labor saving devices available to businesses which are engaged in the daily mailing of large numbers of pieces. Among the advantages of inserter usage has been the reduction in personnel required to process large quantities of outgoing mail. Further, mail room personnel have been relieved of the monotonous task of individually stuffing seemingly insurmountable numbers of envelopes. Inserters have been particularly well adapted for use in the mailing of form letters and the like and have been employed for the insertion of personalized documents, e.g. computer generated checks, cards, etc., into window envelopes.

In U.S. Pat. No. 2,914,895 issued Dec. 1, 1959 to Samuel W. Martin and assigned to the assignee of the present invention, an envelope inserter having a reciprocating ram blade for inserting enclosures into opened envelopes was described. A sheet feeding assembly was detachably mounted to the inserter and included a sloped tray which carried a stack of sheets. A feed roller was carried on a shaft which extended above the tray. The feed roller included a pair of spaced frictional drive portions, and a frictional separator element projected from beneath the tray to cooperate with the feed roller.

Such feeder assembly was typical among the Pitney Bowes Serial 3300 inserters. In the Pitney Bowes Model 3320 Insertamate inserter, a pair of enclosure feeder assemblies were provided, and a transport pathway carried enclosures from one feeder assembly to a pick-up area forward of another enclosure feeder assembly. The feeder assemblies included various modifications from the initial design as disclosed in the Martin Patent (supra), however the basic mode of operation remained substantially consistent.

Among the problems encountered with the feeder assemblies on the Model 3320 inserter were difficulties in adjusting enclosure side guides which engaged the sides of the stack of materials being fed. The adjustment procedure included taking a sample enclosure or envelope and folding it in half, placing the folded edge along the center line of the feeder tray, then unlocking the rear side guide lock knob which was located beneath the tray and moving the rear side guide up to the open edges of the folded material. Thereafter, the folded sheet material was unfolded and positioned on the feed deck, the rear side guide locked and the front side guide unlocked from underneath the tray. The front guide was then set to accommodate the unfolded material and then locked.

Additional difficulties were encountered with regard to the separator which cooperated with the feed wheel from beneath the tray. The separator employed in the Model 3320 inserter comprised a three-fingered stone which was secured beneath the tray and projected upwardly through apertures in the tray in staggered registration with projecting frictional portions of the drive wheel. A shield was slid over the stone to control the amount of stone surface exposed. To adjust the shield, it was necessary to locate the shield beneath the tray and manually grasp a portion of the shield sliding same relative to the stone. Precision shield adjustments were difficult to attain. Adjustment of the separator stone required the operator to reach beneath the feeder tray to grasp and turn an adjustment screw. It could well be appreciated that these adjustment procedures were awkward and presented substantial difficulties for some mail room personnel.

In the event a user desired to employ an inserter for feeding end folded materials, e.g. checks with attached stubs, it was desirable to have the feed roller positioned off center so that it engaged enclosures at the doubled over thickness to eliminate peeling during the feeding and separating operations. Unfortunately, feeder assemblies were not adjustable to provide for off-center feeding and a separate offset feeder was required to be employed.

A further problem encountered with prior feeder assemblies related to the first station feeder assembly of the Model 3320 inserter. This feeder assembly was positioned over a transport pathway which carried enclosures from a second station feeder assembly. A pair of spring biased skis were mounted beneath the tray of the first station feeder assembly and engaged the upper surface of enclosures passing along the pathway to urge the enclosures against a pair of parallel spaced transport belts.

Since the feeder assemblies were separate units individually attachable to the inserter, improper registration between the skis carried by the feeder assembly and the transport belts often occurred. Unfortunately, the skis were not readily adjustable to correct for misalignment.

SUMMARY OF THE INVENTION

An inserter includes a pair of enclosure feeder assemblies and an envelope feeder assembly. Each feeder assembly includes a feed deck comprising a sloped feed tray mounted between a pair of spaced side frames. A pair of side guides are mounted to the tray. The side guides are adjustable for skew alignment and are secured to carriers which are slidable along a shaft for varying the spacing between the guides. Each carrier engages opposite longitudinal spans of an endless belt mounted beneath the tray for simultaneous reciprocal movement from the longitudinal center line of the tray. An operator engageable release tab projects from a carrier which faces the front of the inserter. The release tab extends from a carrier bracket which is spring biased to engage a grating on the undersurface of the tray for fixing the adjusted span between the side guides.

A resilient feed wheel is mounted to a drive shaft which extends between the side frames from a drive unit which includes a magnetic clutch. A prefeed assembly includes a friction wheel driven by the feed wheel. The prefeed assembly drives prefeed wheels which engage a stack of sheet material positioned in the feed deck. The feed wheel and prefeed assembly may be adjusted to an off center position so that end folded enclosures can be accommodated.

A plurality of apertures extend transversely across the tray, and a stone and shield project through selected apertures in staggered registration with sheet engaging portions of the feed wheel. The stone is carried by a bracket which is pivotally mounted to a shaft extending transversely beneath the tray. An eccentric shaft extends transversely beneath the tray and engages the bracket adjacent the stone. An operator actuatable knob accessible at the front of the inserter rotates the eccentric shaft for adjusting the elevation of the stone through the apertures.

A stone shield is carried by the bracket and overlies a portion of the stone. A trailing portion of the shield includes a rack and is maintained at a sloped orientation by the bracket. The rack is engaged by a pinion secured to the bracket pivot shaft which extends transversely beneath the tray. The pivot shaft is rotatable through an operaor accessible knob at the front of the inserter to control the position of the shield.

A ski bracket extends beneath the tray of a first station enclosure feeder assembly which overlies a transport pathway for enclosures fed by a second station enclosure feeder assembly. The transport pathway includes a pair of endless transport belts, and the further bracket carries a pair of spring biased skis which urge enclosures against the transport belts. The ski bracket is adjustably secured to the tray to permit parallel plane registration between the skis and the transport belts. The skis are mounted to the ski bracket through a pair of adjustable slots to provide adjustment for vertical registration between the skis and the belts.

From the above compendium, it will be appreciated that it is an object of the present invention to provide inserter feeder assemblies of the general character described which are not subject to the disadvantages of the prior art as aforementioned.

Another object of the present invention is to provide inserter feeder assemblies of the general character described having an improved feeding mechanism for increased throughput.

A further object of the present invention is to provide inserter feeder assemblies of the general character described which include a feed wheel and a separator stone and which provide simplified operator adjustment of the separator stone.

Yet a further object of the present invention is to provide inserter feeder assemblies of the general character described which include a feed wheel and a separator stone having a stone shield and which provide for simplified adjustment of the shield to control the exposure of the separator stone.

A still further object of the present invention is to provide inserter feeder assemblies of the general character described which include a feed deck having a sloped tray and a pair of side guides and which provide for simplified reliable adjustment of the side guides.

Yet another object of the present invention is to provide inserter feeder assemblies of the general character described for a multiple feeding station inserter having enclosure transport belts wherein a feeder assembly carries adjustably positionable skis for urging enclosures against the transport belts.

Another object of the present invention is to provide inserter feeder assemblies of the general character described which include adjustably positionable feed wheels for accommodating end folded sheet materials.

Other objects of the present invention in part will be obvious and in part will be pointed out hereinafter.

With these ends in view, the invention finds embodiment in various combinations of elements and arrangements of parts by which the said objects and certain other objects are attained, all as fully described with reference to the accompanying drawings and the scope of which is more particularly pointed out and indicated in the appended claims.

BRIEF DESCRIPTION OF THE DRAWINGS

In the accompanying drawings in which is shown one of the various possible exemplary embodiments of the invention:

FIG. 6 is an exploded fragmentary perspective illustration of a shoe which is mounted to a shelf formed at the rear of the feeder tray and which is employed to bias the side guides;

FIG. 7 is a map which indicates the interrelationship between the components illustrated in FIGS. 3 through 6;

FIG. 8 is an exploded perspective illustration of a prefeed assembly and a feed wheel;

DESCRIPTION OF THE PREFERRED EMBODIMENT

Figure 1:
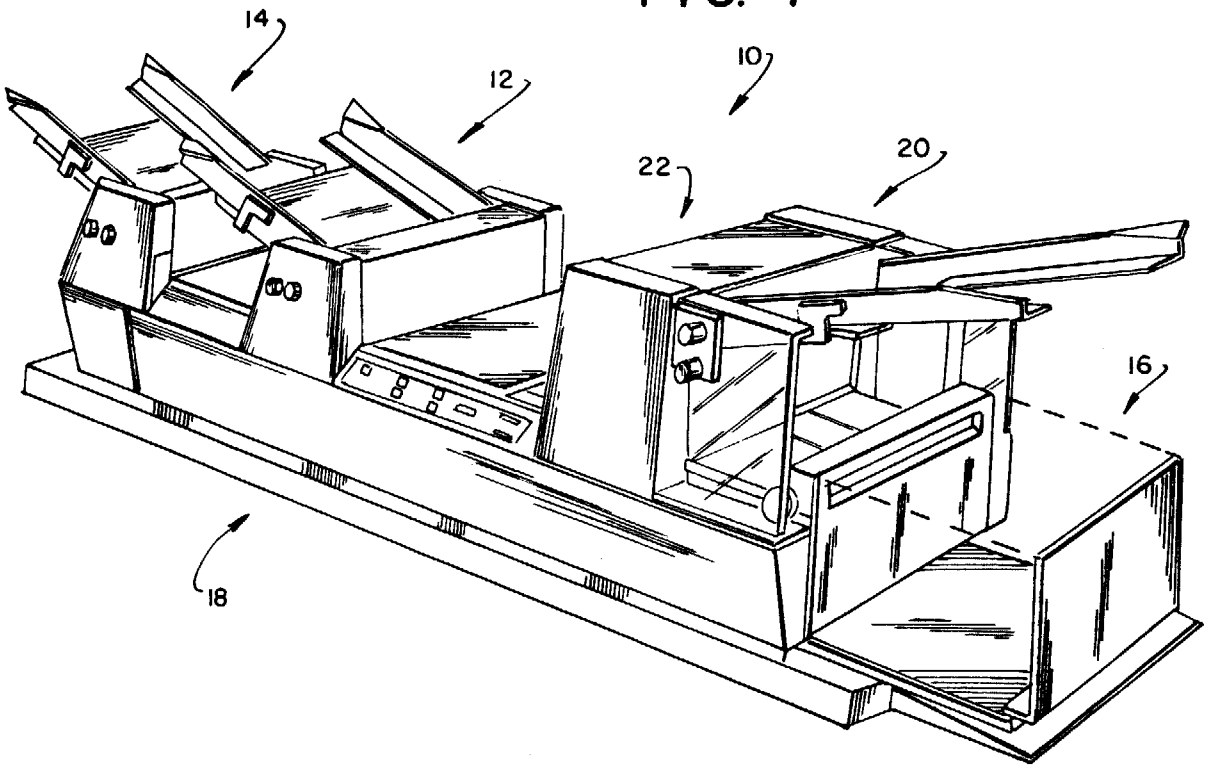
FIG. 1 is a perspective illustration of a typical inserter incorporating feeder assemblies constructed in accordance with the present invention and showing a pair of enclosure feeder assemblies and an envelope feeder assembly.

Referring now in detail to the drawings, the reference numeral 10 denotes generally an inserter embodying the invention. The inserter 10 is similar in construction and operation to the Pitney Bowes Model 3320 Insertamate inserter and includes a first station enclosure feeder assembly 12 and a second station enclosure feeder assembly 14, both constructed in accordance with the present invention. The inserter 10 includes a reciprocating ram which automatically stuffs enclosures fed from the first feeder assembly 12, the second feeder assembly 14, or both into an envelope. The inserter delivers each stuffed envelope into a tray 16. An operator loads envelopes directly from an envelope carton into an envelope feeder assembly 20 also constructed in accordance with and embodying the present invention. Positioned adjacent the envelope feeder assembly 20 is an envelope flapper which opens the envelope flaps prior to delivery of fed envelopes to an envelope station where the enclosures are inserted.

In operation, enclosures and envelopes are individually removed from their stacks by the feeder assemblies 12, 14, 20. Enclosures are transported from the second station enclosure feeder assembly 14 to the first station enclosure feeder assembly 12 along a transport pathway by a pair of endless transport belts. Enclosures fed from the first station enclosure feeder assembly 12 or transported from the second station enclosure feeder assembly 14 to the first station enclosure feeder assembly 12 are transported through a further transport pathway which extends from the first station enclosure feeder assembly through and including a ram pick-up station. From the ram pick-up station, enclosures are carried by the reciprocating ram into the envelope which is seated at the envelope station.

The feeder assemblies 12, 14 and 20 of the inserter 10 include many common structural features and modes of operation. For the purpose of avoiding duplication, the drawings illustrate the first station feeder assembly 12 as a typical feeder assembly constructed in accordance with the present invention. Accordingly, the following description, while relating to all feeder assemblies 12, 14, 20, will be directed to details of the first station feeder assembly 12. Significant differences between the remaining feeder assemblies and the first station feeder assembly will, however, be explained.

Pursuant to the present invention, adjustment controls for the feeder assemblies 12, 14, 20 have been provided for direct access to the operator. The inserter 10 can be considered to have a front face denoted generally by the reference numeral 18 and a rear face denoted generally by the reference numeral 22. It should be additionally appreciated from an observation of FIG. 1 that various safety covers have been employed for the purpose of covering moving components of the feeder assemblies and provide an esthetically pleasing, yet functional, appearance.

Figure 2:
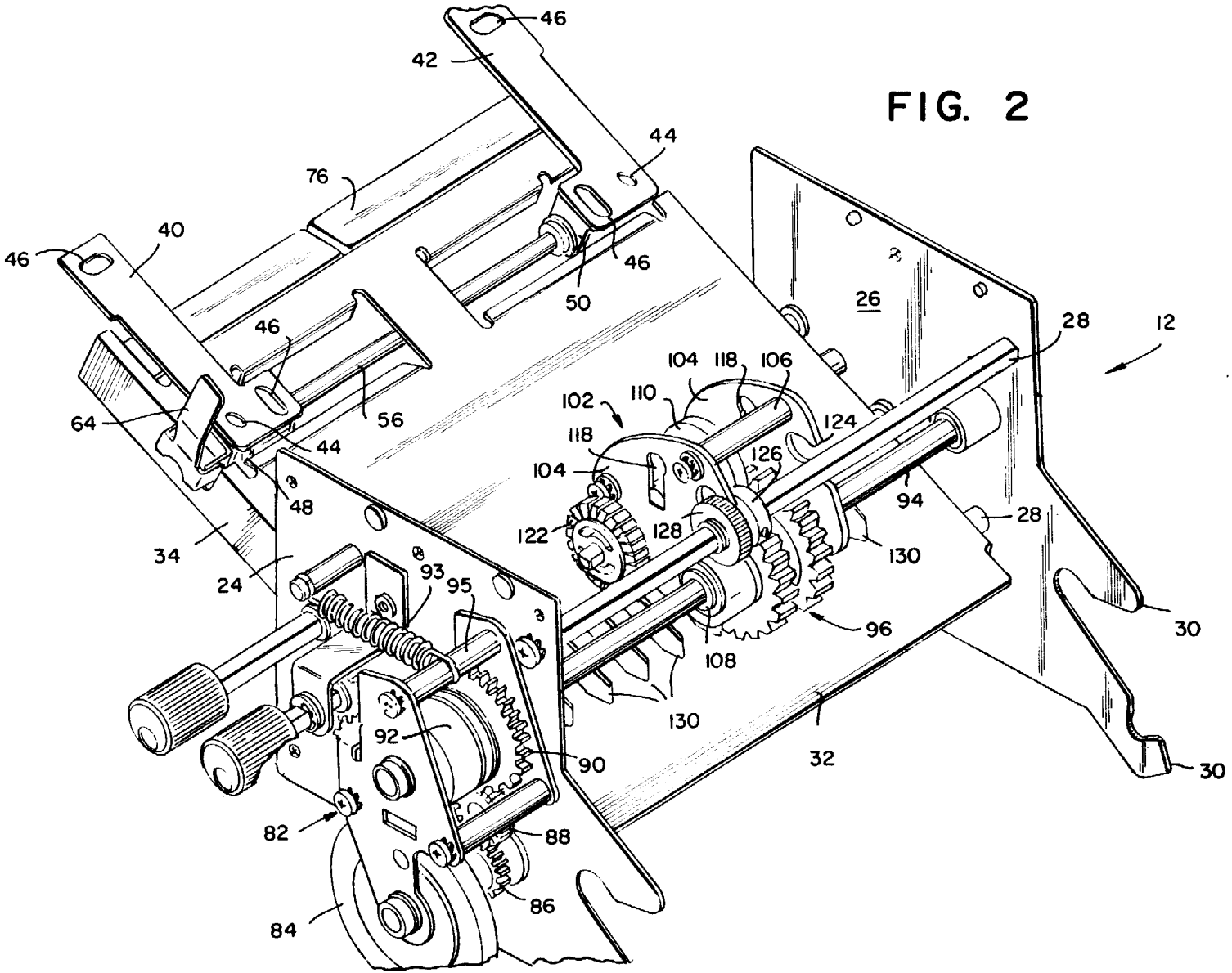
FIG. 2 is a fragmentary perspective illustration of a typical inserter feeder assembly in accordance with the present invention with safety covers removed and various components omitted for the purpose of clarity and showing a sloped tray mounted between a pair of side frames.

Referring now to FIG. 2 wherein the first station feeder assembly 12 is illustrated with portions deleted for clarity, the feeder assembly includes a pair of side frames 24, 26 which are maintained in spaced parallel relationship by a plurality of rigid spacer bars 28. The side frames 24, 26 include forward protuberances 30 having suitable notched surfaces for removable mounting to a frame of the inserter 10. The feeder assemblies are thus separately manufacturable as mass produced individual units and may be easily installed and replaced at the user's premises.

Figure 3:
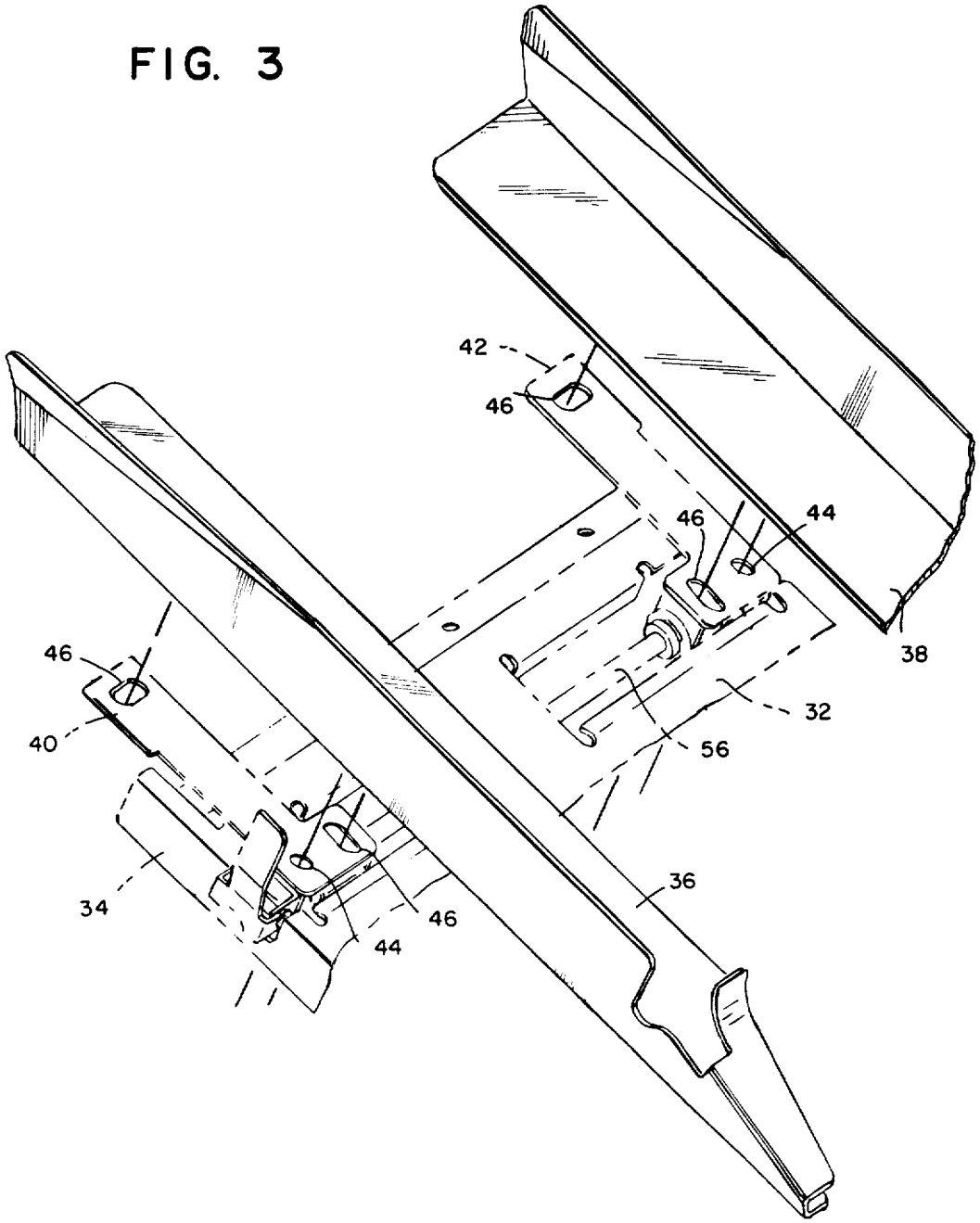
FIG. 3 is a fragmentary perspective exploded view of a pair of enclosure side guides and their carriers, with a portion of the feeder tray fragmentized and shown in phantom.
Figure 4:
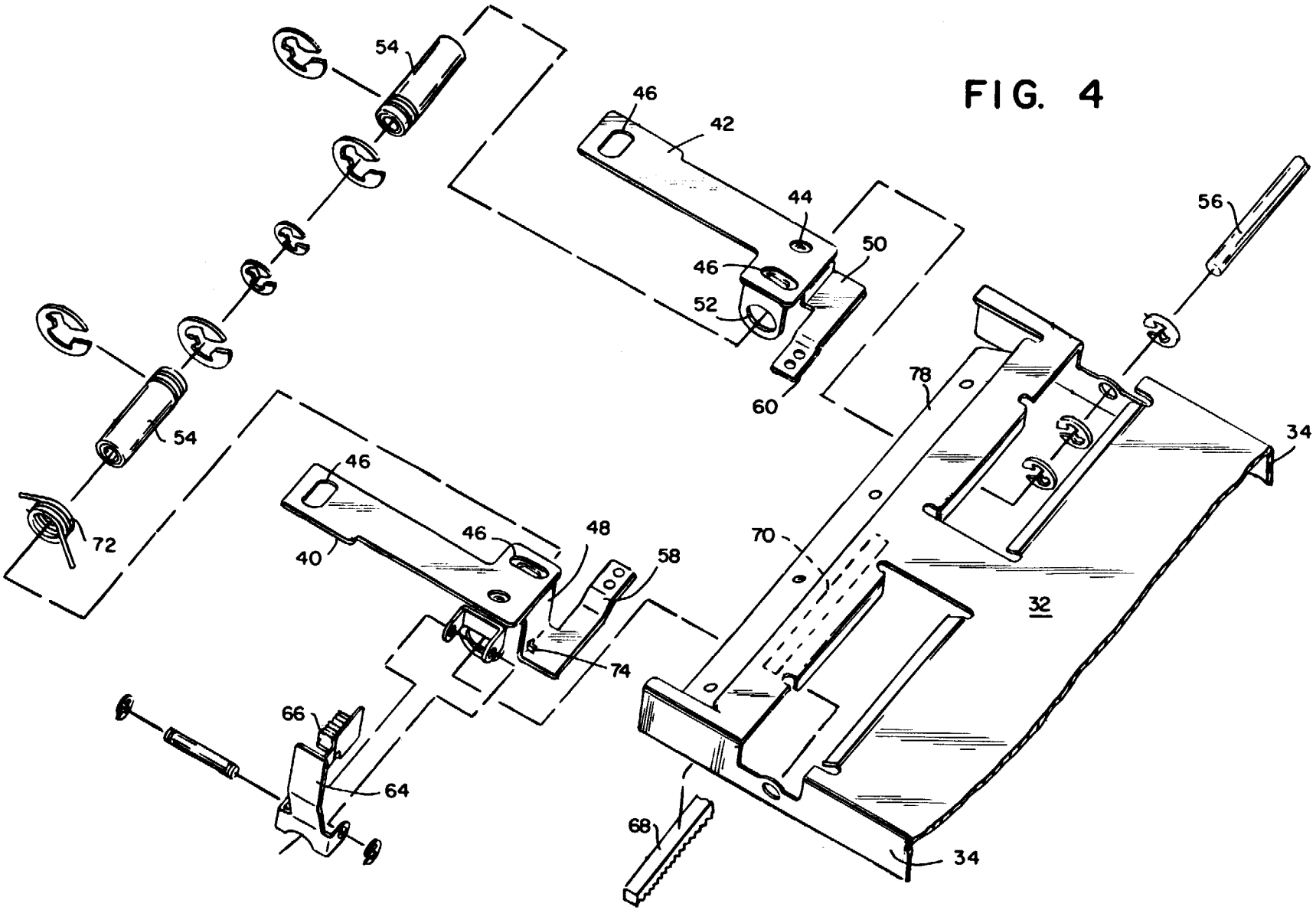
FIG. 4 is an exploded perspective illustration of a fragmentary portion of the feeder tray and showing the side guide carriers and the manner in which they are mounted to the tray.
Figure 5:
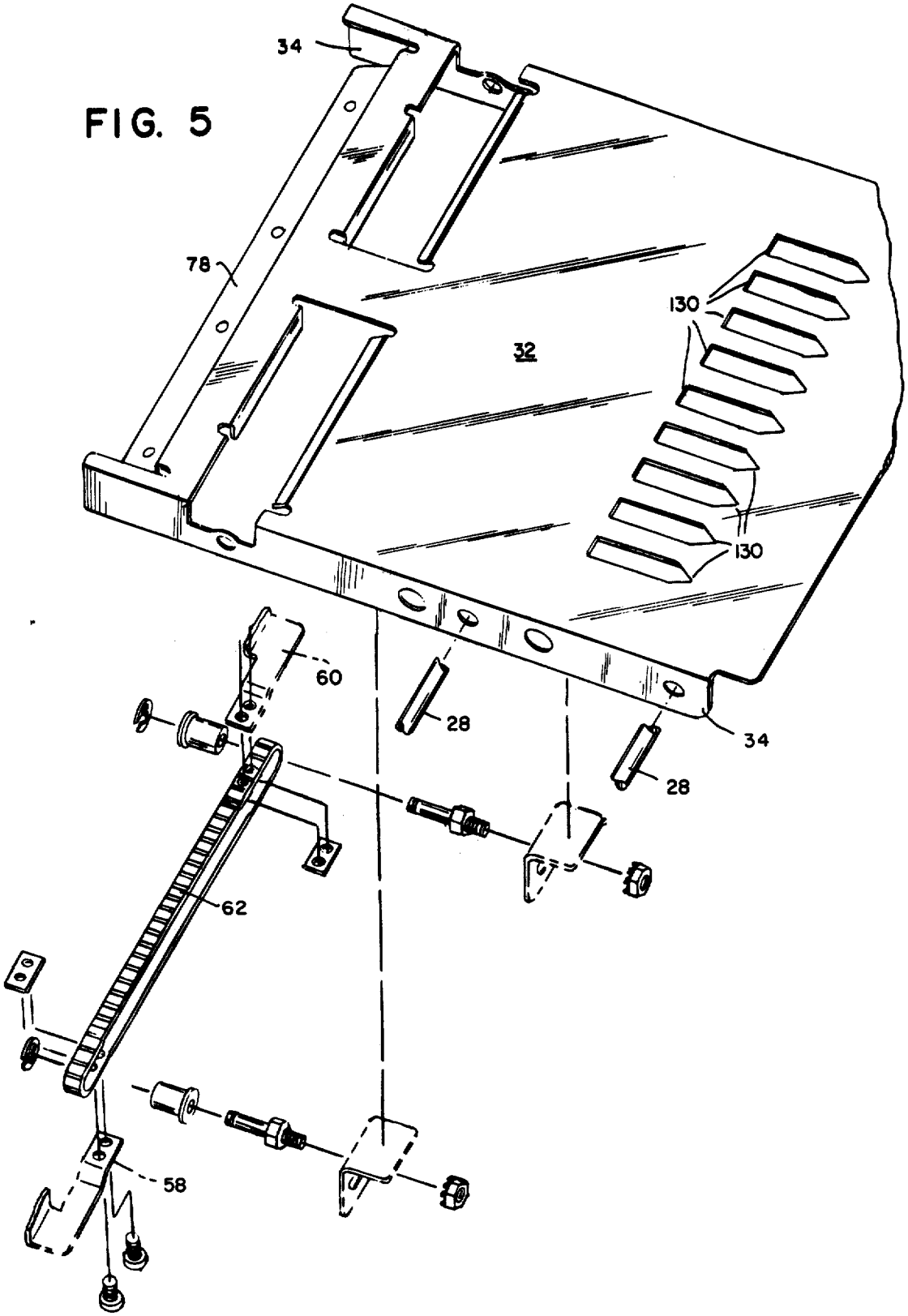
FIG. 5 is a further exploded perspective illustration of a portion of the feeder tray and an endless belt which is mounted beneath the tray and to which the side guide carriers are joined.
Figure 9:
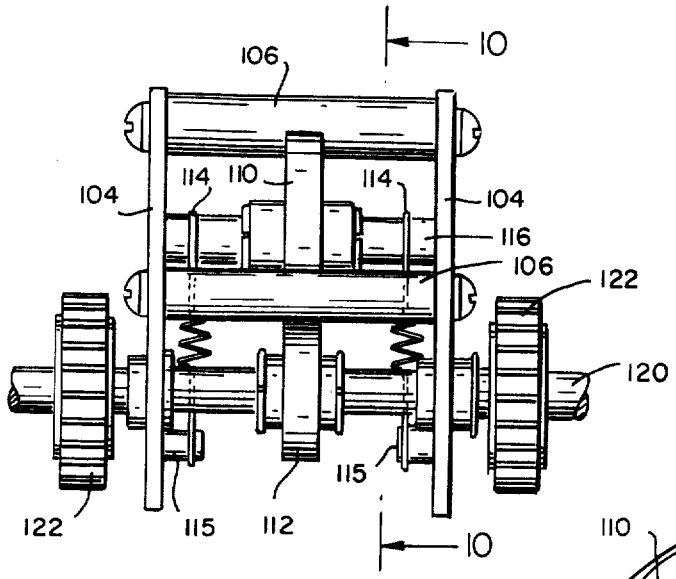
FIG. 9 is a rear elevational view of the prefeed assembly.
Figure 10:
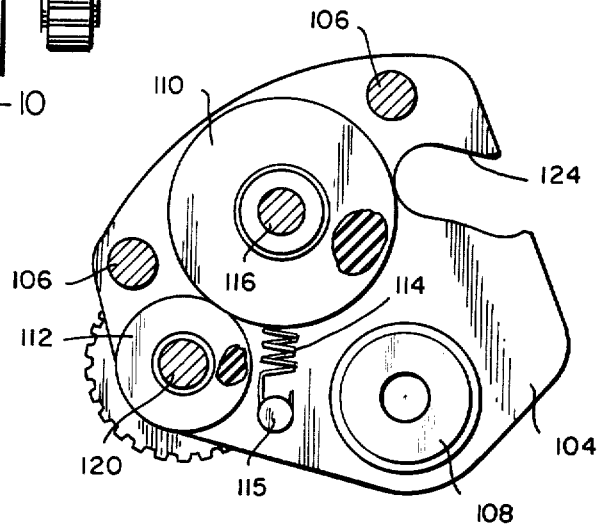
FIG. 10 is a sectional view through the prefeed assembly, the same being taken substantially along line 10—10 of FIG. 9.

An enclosure carrying tray 32 is mounted in a sloped orientation between the side frames 24, 26. The tray 32 includes downturned side walls 34 having suitable apertures through which two spacers bars 28 extend as illustrated in FIG. 5. A pair of symmetrical side guides 36, 38 (FIG. 3) are adjustably secured to the tray 32 for engagement with the ends of a stack of enclosures carried on the tray 32. The side guides 36, 38 include threaded studs extending downwardly through apertures formed in a carrier 40, 42, respectively. It should be appreciated that each carrier includes a circular aperture 44 and two slotted apertures 46 so that the side guides can be pivoted about the circular aperture 44 for skew adjustment. Once the skew adjustment has been made suitable bolts are employed to secure the side guides to their respective carriers.

A mounting bracket 48, 50 is secured to the carriers 40, 42, respectively, at the forward end of each carrier. Each bracket includes a pair of transverse apertures 52 through which a hollow sleeve 54 extends. The brackets 48, 50 are positioned within spaced rectangular openings formed in the tray 32 adjacent the trailing end. A post 56 extends through apertures in the side walls 34 of the tray and through the sleeves 54 in registration with the rectangular openings. As such, the brackets 48, 50 are slidable along the post 56 within the confines of the rectangular openings in the tray 32.

The bracket 48 includes a forwardly projecting flange 58 which extends beneath the tray 32 while the bracket 50 includes a similar flange 60 which, however, extends to a different elevation from that of the flange 58.

In order to provide simultaneous symmetrical movement of the side guides, an endless belt 62 is mounted to the underside of the tray 32 forwardly of the rectangular openings, and the flanges 58, 60 are secured to opposite longitudinal spans of the belt as illustrated in FIG. 5. Details of the mounting arrangement for the belt 62 are shown in FIG. 5. They include a pair of brackets projecting downwardly from the tray underside. The latter brackets have slots through which posts are adjustably mounted. Journalled about each post is a pulley with the belt 62 looped about the pulleys.

In order to lock the side guides in an adjusted position, a tab bracket 64 is pivotally mounted to the carrier bracket 48 adjacent the front of the inserter. The tab bracket 64 includes a transversely extending arm which carries a ribbed grating 66. The grating 66 is positioned beneath the tray rearwardly of the rectangular opening through which the bracket 48 extends. A mating grating 68 is fixed to the undersurface of the tray 32 in the position 70 shown in dashed lines. To lock the gratings 66, 68, a torsion spring 72 is mounted about the sleeve 54. One of the spring legs engages the bracket arm carrying the grating 66, and the other leg engages an aperture 74 formed in the carrier bracket 48. The torsion spring 72 thus urges the grating 66 against the grating 68 to fix the adjusted position of the side guides.

If an operator desires to adjust the side guides, he need merely grasp the tab bracket 64 and the side wall of the front side guide 36 with one hand and pivot the tab bracket 64 toward the side bracket 36 to release the engagement between the gratings 66, 68.

In order to promote the feeding of enclosures carried on the tray 32, it is desirable to resiliently bias the side guides upwardly. For this purpose, a longitudinal shoe 76 is secured within a downturned platform 78 which is formed at the trailing edge of the tray 32. As illustrated in FIG. 6, the shoe 76 is configured to be received in the platform and may be formed as a channel member having downturned legs.

Figure 11:
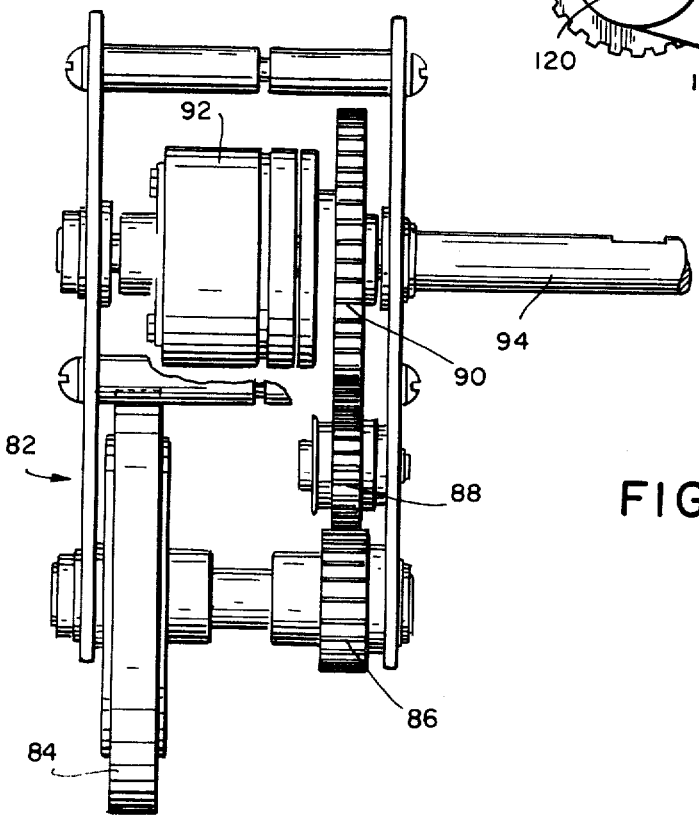
FIG. 11 is a fragmentary front elevational view of a drive unit for the feed wheel showing a magnetic clutch which is employed to control a drive shaft on which the feed wheel is mounted.

A plurality of threaded studs project downwardly from the shoe 76 through apertures provided in the shelf 78. A helical coil spring 80 is positioned about the studs to upwardly bias the shoe with the studs being captively retained by nuts from the underside of the tray. A drive unit 82 is positioned next to the front of the side frame 24 and is normally concealed by a decorative cover. As illustrated in FIGS. 2 and 11, the drive unit includes a friction wheel 84 which is, in turn, driven by a further friction wheel extending from a power take-off shaft projecting from the inserter in a manner similar to that disclosed in the Martin patent, supra, incorporated herein by reference and in the Pitney Bowes Model 3320 inserter.

The friction wheel 84 is fixed to a shaft journalled between side walls of the drive unit 82 with the shaft having a pinion 86 adjacent its opposite end. The pinion 86, in turn, drives an idler gear 88 which engages an input gear 90 of a magnetic clutch 92. To maintain driving engagement between the inserter take-off shaft (not shown) and the friction wheel 84, a spring 93 extends between a drive unit side wall spacer 95 and a post which projects from the side frame 24. The friction wheel and take-off shaft wheels may include urethane peripheries for reduced operating noise.

The magnetic clutch 92 is of conventional design and readily available from many sources such as Inertia Dynamics Inc., of Collinsville, Conn. When electrically actuated, the clutch 92 is effective to provide positive engagement between the continually driven input gear 90 and an output or drive shaft 94.

The drive shaft 94 is journalled through suitable bearings in the side frames 24, 26 and carries a feed wheel 96 which includes a pair of spaced frictional drive portions 98 which project radially to a diameter greater than that of a central intermediate portion. The drive portions 98 are adapted to frictionally engage sheets of enclosures and feed them from the stack carried by the tray 32. The entire feed wheel 96 may be molded of a suitable material such as a urethane about a central hub 100.

It should be appreciated that the engagement between the drive shaft 94 and an aperture extending through the hub should not permit slippage when the drive shaft is rotated in a counterclockwise direction as viewed from FIGS. 2 and 8. Actually, the drive shaft 94 is either stopped or rotating in a counterclockwise direction when the inserter 10 is operating.

As previously mentioned, a feature of the invention resides in the ability to move the feed wheel 98 laterally with respect to the tray 32 so that the feed wheel may be positioned over and in registration with any doubled over portions of an end folded enclosure. In order to provide such adjustment, which necessitates free translational movement of the hub 100 about the drive shaft 94, the hub comprises a one way clutch assembly. Suitable one way clutch assemblies for implementation as hubs of the feed wheel include drawn cup clutch and roller bearing assemblies such as a Torrington roller clutch no. RCB-061014-FS. Such clutches are typically employed for applications wherein torque is to be transmitted between a shaft and a housing in one direction while free overrun is required in the opposite direction.

The intermediate portion of the feed wheel 96 is employed as a drive wheel for a prefeed assembly denoted generally by the reference numeral 102. The prefeed assembly 102 comprises a pair of mating side panels 104 maintained in spaced relationship by a pair of spacer rods 106. A pair of bearings 108 are seated in registered apertures of each side panel 104 and are adapted to receive the drive shaft 94. With the drive shaft 94 extending through the bearings 108 and the feed wheel 96 positioned between the side panels 104 (as illustrated in FIG. 2), the intermediate portion of the feed wheel 96 is engaged by an idler friction roller 110.

The roller 110 is biased against both the intermediate portion of the feed roller and a driven roller 112 by a pair of helical coil springs 114. The springs 114 extend between a post 115 fixed to the side panels 104 and a shaft 116 which is vertically movable along a slotted aperture 118 in the side panel. The roller 110 is fixed to the shaft 116.

The driven roller 112 is, in turn, fixed to a shaft 120 which is journalled between the side panels 104. The shaft 120 extends beyond the side panels where one or more frictional prefeed wheels 122 are fixed to the shaft 120. The prefeed wheels 122, as well as the rollers 110, 112, may be formed of any suitable material having a relatively high coefficient of friction such as urethane. It has been found to be desirable to employ two prefeed rollers on the shaft 120 in conjunction with the prefeed assembly of the envelope feeder 20.

The side panels 104 additionally include an oblong cut-out 124 which is adapted to adjustably overlie an upper spacer bar 28 as shown in FIGS. 2 and 8. A two piece locking collar engages one of the cut-outs 124 and the upper spacer bar 28 for the purpose of adjustably positioning and locking both the prefeed assembly and the feed wheel.

The collar includes a headed male sleeve 126 having a threaded portion. A set screw extends axially through the sleeve head and engages the upper spacer bar 28. A mating nut 128 extends over the spacer bar 28 and is adapted to receive the threaded portion of the sleeve 126. The entire prefeed assembly may be pivoted about the drive shaft 94 to an adjusted position for accommodating the stack of enclosures and locked in such adjusted position by tightening the nut 128. When the nut 128 is tightened, the side panel 104 in the area of the cut-out 124 is engaged between a shoulder of the male sleeve and a shoulder of the nut for maintaining the prefeed assembly 102 in its adjusted angular orientation relative to the drive shaft 94.

If it is desired to offset the feed wheel and the prefeed assembly for the purpose of feeding a stack of end folded enclosures, the set screw in the male sleeve 126 is loosened, whereupon the prefeed assembly 102 may be slid longitudinally along the drive shaft 94. Since the feed wheel 96 is retained between the side panels 104, the feed wheel moves along with the prefeed assembly. Once the desired position is attained, the set screw is tightened and the thumb nut may be loosened to adjust the angular orientation of the prefeed assembly 102.

As indicated in FIGS. 2 and 5, the tray 32 includes a plurality of equidistantly spaced apertures 130. The feed wheel 96 is operatively positioned such that the frictional drive portions 98 are registered with the portions of the tray 32 which extend between the apertures 130. Projecting upwardly from beneath the tray 32 and through three of the apertures 130 is staggered relationship to the drive portions 98 is a three fingered separator stone 132 illustrated in FIG. 12.

Figure 12:
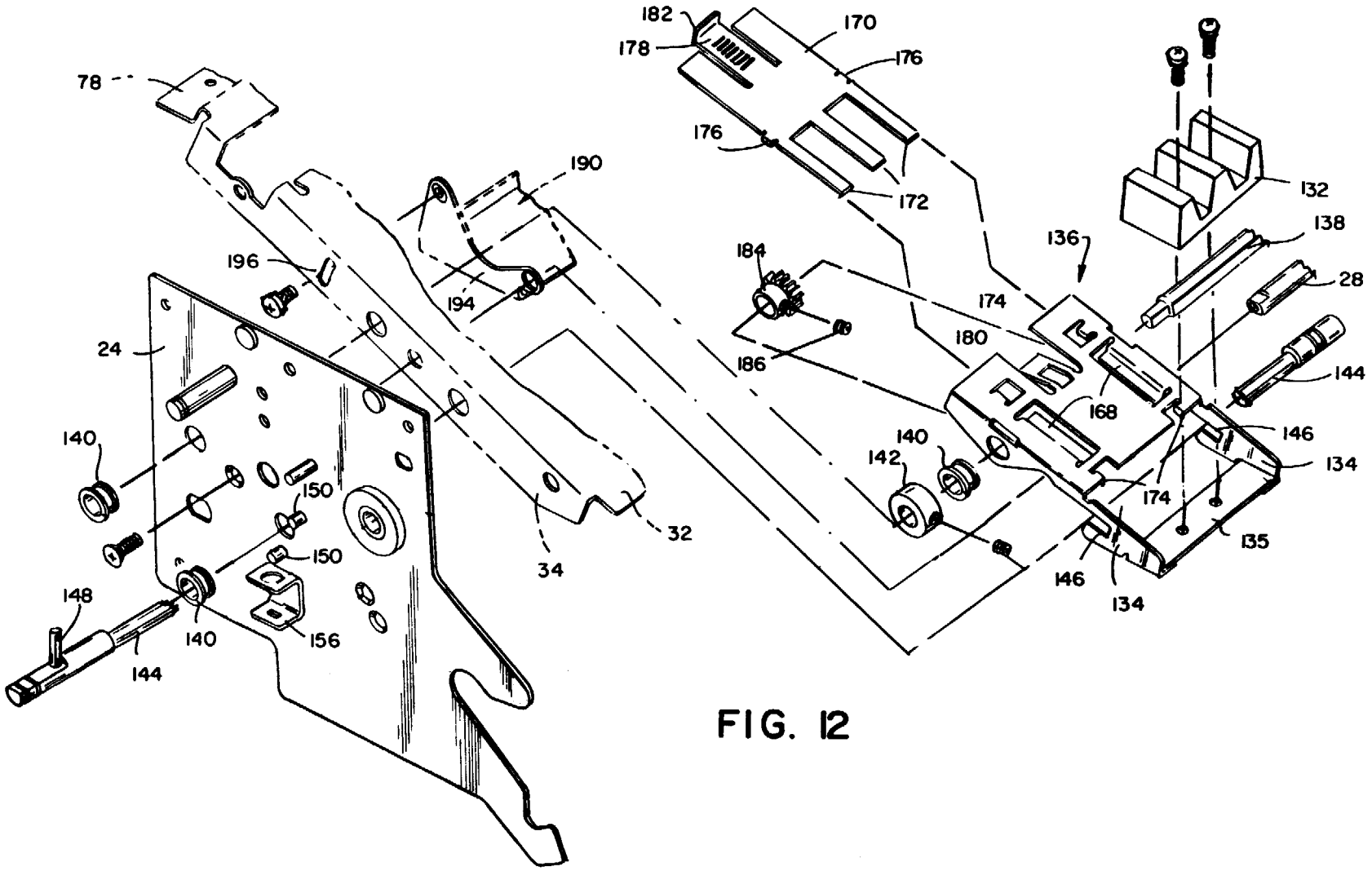
FIG. 12 is an exploded fragmentary perspective illustration of one of the side frames, a portion of the tray, a portion of a ski bracket, and a separator stone and shield bracket and illustrating the manner in which the separator stone and the shield are adjusted.

The stone 132 is secured to a platform 135 which spans between a pair of side walls 134 of a stone and shield bracket 136. As illustrated in FIG. 12, conventional bolts may be employed to secure the stone to the platform 135. The bracket 136 is journalled about a shaft 138 which extends between the side frames 24, 26 and through suitable bushings 140 seated in apertures extending through the tray side walls 134. Further bushings 140 are seated in registered apertures of the side frames 24, 26. The stone 132 is adjustably positioned to extend through selected apertures 130 corresponding to the position of the feed wheel by being slid transversely along the shaft 138. A pair of thrust collars 142 having a set screw are employed on the shaft 138 adjacent the opposite side walls 134 to fix the adjusted position of the bracket 136.

An eccentric shaft 144 extends transversely between the side frames 24, 26 with the shaft shown fragmented in FIG. 12. The shaft 144 includes enlarged end portions which are journalled for rotation through a bushing 140 seated in an aperture of each side frame and with the eccentric span of the shaft engaging a notched portion 146 of each bracket side wall 134.

Rotation of the eccentric shaft 144 will cause the bracket 136 to pivot about the shaft 138 and vary the elevation of the stone fingers which project above the tray.

It should be noted that the enlarged portion of the eccentric shaft which is journalled at the side frame 24 includes a radially projecting arm 148. The arm 148 selectively engages two protuberances 150 which project forwardly from the side frame 24 to provide limit stops for rotation of the shaft 144.

Figure 13:
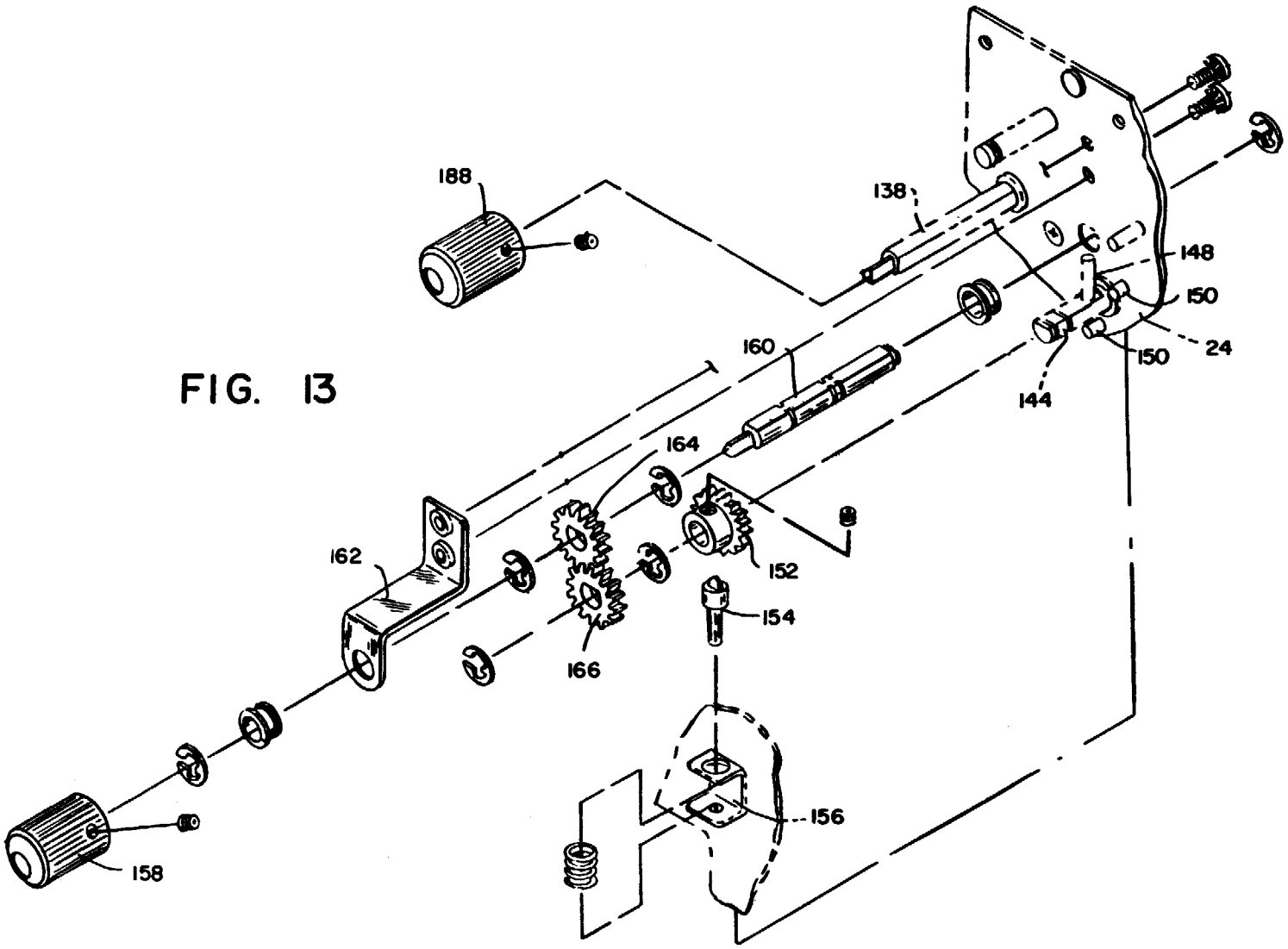
FIG. 13 is a fragmentary exploded perspective illustration of the side frame illustrated in FIG. 12 and showing further components employed for the stone and shield adjustment.

With reference now to FIG. 13, it will be seen that a spur gear 152 is fixed to the enlarged portion of the shaft 144 forward of the arm 148. A detent plug 154 is carried in a bracket 156 which projects from the side frame 24. The detent plug is spring biased upwardly against the teeth of the spur gear 152 to provide detent stops for rotation of the eccentric shaft 144.

A stone adjustment knob 158 is accessible from the front cover of the feeder assembly for rotation of the eccentric shaft 144 through an intermediate shaft 160 journalled between the side frame 24 and a supporting bracket 162. The stone adjustment knob 158 is fixed to the intermediate shaft 160 which carries a spur gear 164. The gear 164 is in driving engagement with a further spur gear 166 fixed to the eccentric shaft 144. Thus, when the knob 158 is rotated, the eccentric shaft rotates.

Returning now to FIG. 12, the bracket 136 includes a pair of longitudinal shelves 168 formed as depressed areas cut out of its upper surface. The shelves 168 are adapted to slidingly receive a stone shield 170.

The shield 170 is formed of a sheet of resilient material such as spring steel or the like in generally rectangular configuration. Adjacent the forward end of the shield 170, a plurality of fingers 172 extend. The fingers 172 are designed to be adjustably positioned over the three fingers of the stone 132 and project through the same apertures 130 as the stone fingers.

The shield 170 is of a width to be accommodatingly received between the side walls of the shelves 168 which retain the upper surface of the shield against the undersurface of the bracket 136. The upper surface of the bracket 136 includes downturned cut-out tabs 174 which engage the side edges of the shield 170 to provide guides for the sliding movement of the shield 170 relative to the bracket 136. To provide a stop for rearward movement of the shield, a pair of downwardly projecting side tabs 176 are formed in the shield and engage the front edge of the shelves 168.

It should be noted that a rear portion of the shield is trifurcated by a pair of longitudinal slits extending from its trailing edge. A center tang portion 178 includes a plurality of parallel rectangular cut-outs which function as a rack in a manner to be described hereinafter. The bracket 136 is similar trifurcated by a pair of slits extending longitudinally from its trailing edge with a central portion 180 being downwardly arched and including a rectangular aperture.

With the shield 170 operatively carried in the bracket 136, the shelves 168 maintain the shield against the undersurface of the bracket. The tang 178 is downwardly bent beneath the central arched portion 180 of the bracket with the rectangular cut-outs forming the rack in substantial registry with the rectangular aperture of the central portion 180. An upwardly bent trailing edge 182 of the tang will engage the trailing edge of the central portion 180 to provide a limit stop for forward movement of the shield.

In order to move the shield 170 relative to the stone, the pivot shaft 138 includes a pinion 184 fixed thereto by a set screw 186. The pinion 184 engages the rack formed by the cut-outs in the tang 178. The shaft 138 is rotated by a knob 188 fixed to its forward end. It should now be appreciated that the downwardly arched central portion 180 arcuately bends the tang 178 thereby facilitating a more positive driving engagement with the pinion 184 than that which would be obtained with tangential engagement between the rack and pinion.

The feeder assembly 12 described to the present juncture is typical of the improved structure of the second station feeder assembly 14 and the envelope feeder assembly 20. With respect to the envelope feeder assembly 20, however, it should be noted that the tray is sloped in the opposite direction and that the drive unit is positioned adjacent the rear face 22 of the inserter while the stone and shield adjustment knobs extend through the cover of the side frame facing the front 18 of the inserter.

Since end folded materials requiring offset feeding are not encountered when feeding envelopes, there is no necessity for adjusting the feed wheel and prefeed assembly to offset positions. The tray of the envelope feeder assembly 20 includes only three spaced apertures 130 which are symmetrically positioned about the center line. The same stone and shield arrangement employed in conjunction with the enclosure feeder 12 may be used, however there is no need to alter the position of the bracket 136 along the shaft 138 in the envelope feeder assembly 20.

As previously mentioned, the first station enclosure feeder assembly 12 overlies a transport pathway which carries enclosures from the second station feeder assembly 14. The transport pathway itself is not part of the present invention and is similar to that disclosed in the Martin patent (supra) and that currently employed in the Pitney Bowes Model 3320 inserter. Included in the transport pathway are a pair of parallel endless transport belts.

Figure 14:
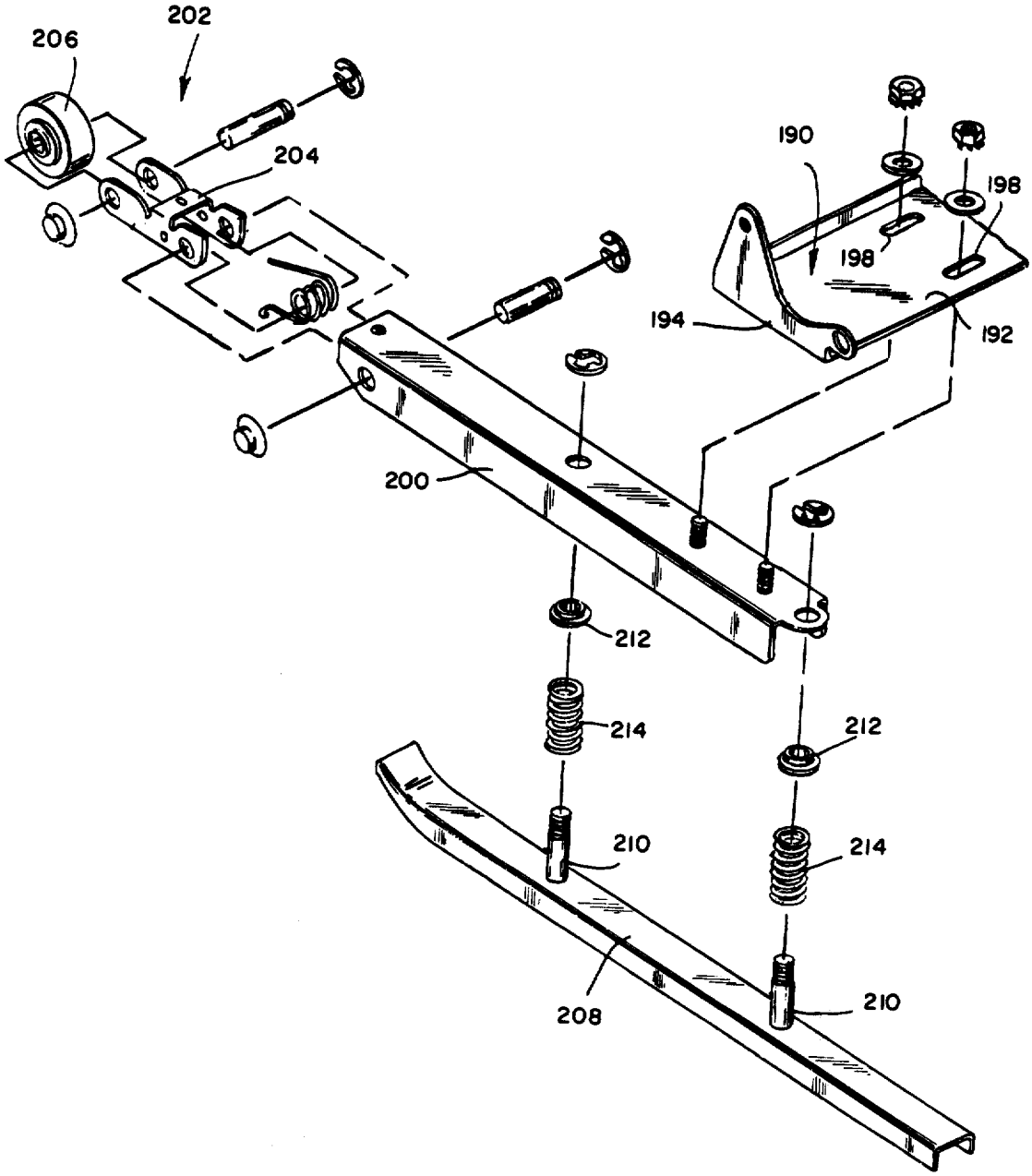
FIG. 14 is an exploded perspective illustration of a typical ski assembly and a fragmentary portion of the ski bracket and showing the manner in which the ski assembly is adjustably secured to the bracket.

The first station feeder assembly 12 includes an adjustable ski bracket 190 illustrated in FIGS. 12 and 14 for mounting a ski mechanism designed to engage the upper surfaces of enclosures in the pathway and urge the enclosures against the transport belts. Pursuant to the invention, the ski mechanism is adjustably mounted to permit registration with the support belts.

The bracket 190 is symmetrical about the longitudinal center line of the tray 32. For the purpose of simplifying the description and illustrations, only portions of the ski bracket 190 are shown. The ski bracket 190 includes a planar panel 192 which extends transversely beneath the tray 32. At the ends of the panel 192, the ski bracket 190 includes upturned side walls 194. The side walls 194 are spaced apart a distance less than the distance between the side walls 34 of the tray, and one of the spacer bars 28 extends through a forward aperture of the bracket side walls 194 and through registered apertures in the tray side walls 34 and in the side frames 24, 26.

The ski bracket 190 is journalled for adjustable rotation about the spacer bar 28 and may be fixed in its adjusted position by a screw which extends through an arcuate slot 196 in the tray side wall 34 which engages a threaded aperture in the bracket side wall 194.

As illustrated in FIG. 14, the ski bracket includes a pair of slots 198 along the panel 192 through which a pair of threaded shafts extend. The threaded shafts are fixed to a longitudinal ski frame channel 200. At the trailing end of the channel, a pick-up roller assembly 202 is mounted. The roller assembly 202 includes a carriage 204 having a roller 206 at one end. Extending transversely between the sides of the channel and the opposite end of the carriage 204 is a pin which serves as a pivotal mount. The pin carries a torsion spring to downwardly bias the roller end of the carriage.

Mounted to and downwardly biased from the channel 200 is a ski 208. The ski 208 includes a pair of posts 210, the ends of which are received in threaded collars 212 which, in turn, are seated in apertures in the channel 200 and are secured thereto by suitable means such as clips. A helical coil spring 214 is seated about each post and biases the ski 208 downwardly away from the carriage and into engagement with the upper surface of enclosures in the transport pathway.

While only a portion of the ski bracket 190 and a single ski 208 have been described, the ski bracket 190 includes symmetrically positioned slots 198 adjacent its opposite end through which an identical ski carriage and ski are mounted.

The skis 208 are adjustable for parallelism alignment. Such adjustment is provided by loosening the nuts which engage the threaded posts extending from the channel 200 through the slotted apertures 298 in the panel 192. Furthermore, the slots 198 permit adjustment of the spacing between the skis on each side of the tray. Thus, when the first station feeder assembly 12 is mounted to an inserter 10, it is possible to provide adjustments to accommodate variations in spacing between the transport belts of the inserter. As previously mentioned, the ski bracket 190 is in itself pivotable about the spacer bar 28. Such adjustment will permit proper adjustments for parallelism between the transport belts and the skis.

In operation, the skis are employed to exert a downward pressure upon advancing enclosures to maintain driving engagement between the enclosures and the transport belts which are registered beneath the skis.

It should be understood that only the first station feeder assembly 12 employs a ski bracket and carries skis, however, economic mass production fabrication techniques might very well suggest utilizing the same tray 32 for all feeder assemblies and merely not employing the ski bracket 190 in the envelope feeder assembly 20 and the second station feeder assembly 14. Further, the same drive unit 82, feed wheel 96 are prefeed assembly 102 may be employed for all feeder assemblies.

Thus, it will be seen that there are provided improved inserter feeder assemblies which achieve the various objects of the invention and which are well suited to meet the conditions of practical use.

As various changes might be made in the embodiments above set forth, it is to be understood that all matter herein described or shown in the accompanying drawings is to be interpreted as illustrative and not in a limiting sense.

Having thus described the invention, there is claimed and desired to be secured by Letters Patent:

1. A feeder assembly for selectively feeding successive sheet material from a stack, the feeder assembly comprising a tray for carrying the stack of sheet materials, means forming a pair of guides for engaging the stack, means adjustably securing each guide relative to the tray, said securing means including means for adjusting the guides relative to one another for parallelism, the securing means including a pair of carrier means, each guide being secured to a respective carrier means, and means for simultaneously moving both carrier means for symmetrical placement of the guides relative to the tray, means for retaining the guides in an adjusted position, the retaining means including friction means extending from one carrier means and means biasing the friction means toward the underside of the tray, means mounting the tray in a sloped plane and guide biasing means for urging one end of each guide in a direction perpendicular from the plane of the tray, the guide biasing means comprising shoe means engaging the underside of each guide adjacent the upper end of the tray, whereby feeder assembly set-up is simplified.

2. A feeder assembly constructed in accordance with claim 1 wherein the means for adjusting for parallelism includes mounting means projecting from each guide and means forming slots in the respective carrier means, the mounting means extending through the slots.

3. A feeder assembly constructed in accordance with claim 1 further including tab means, means pivotally mounting the tab means to one carrier means, the friction means projecting from the tab means, the biasing means engaging the tab means, the tab means being pivotable against the bias of the biasing means and toward the guide carried by the one carrier means to release the friction means.

4. A feeder assembly constructed in accordance with claim 1 wherein the friction means comprises a grating, the retaining means further including means forming a mating grating on the underside of the tray.

5. A feeder assembly constructed in accordance with claim 1, the securing means further including means mounting each carrier means for translational movement relative to the tray, the means for simultaneously moving both carrier means including means projecting from each carrier means, direction reversal means mounted beneath the tray, the projecting means of each carrier means engaging the direction reversal means, the projecting means of one carrier means driving the direction reversal means, the direction reversal means driving the projecting means of the other carrier means in an opposite direction.

6. A feeder assembly constructed in accordance with claim 5 wherein the direction reversal means comprises an endless belt mounted in a configuration including two substantially parallel spans, the projecting means engaging opposite spans.

* * * * *